US006766635B2

(12) United States Patent
Andrews

(10) Patent No.: US 6,766,635 B2
(45) Date of Patent: Jul. 27, 2004

(54) FRICTION-TEXTURED CUT-RESISTANT YARN

(75) Inventor: Gregory V. Andrews, Concord, NC (US)

(73) Assignee: World Fibers, Inc., Concord, NC (US)

( * ) Notice: Subject to any disclaimer, the term of this patent is extended or adjusted under 35 U.S.C. 154(b) by 0 days.

(21) Appl. No.: 10/430,746

(22) Filed: May 6, 2003

(65) Prior Publication Data

US 2003/0192298 A1 Oct. 16, 2003

Related U.S. Application Data

(63) Continuation of application No. 09/929,148, filed on Aug. 14, 2001, now Pat. No. 6,591,599.
(60) Provisional application No. 60/225,669, filed on Aug. 16, 2000.

(51) Int. Cl.[7] ..... D02G 3/02; D02G 3/24
(52) U.S. Cl. ..... 57/246; 57/245; 57/334
(58) Field of Search ..... 57/236, 238, 243–247, 57/334–343

(56) References Cited

U.S. PATENT DOCUMENTS 5,423,168 A 6/1995 Kolmes et al.
5,568,657 A 10/1996 Cordova et al.
5,597,649 A 1/1997 Sandor et al.
5,628,172 A 5/1997 Kolmes et al.
5,632,137 A 5/1997 Kolmes et al.
5,851,668 A 12/1998 Sandor et al.
6,341,483 B1 1/2002 Kolmes et al.
6,395,080 B1 * 5/2002 Cass et al. ..... 106/166.01

* cited by examiner

*Primary Examiner*—John J. Calvert
*Assistant Examiner*—Shaun R. Hurley
(74) *Attorney, Agent, or Firm*—Adam Evans P.A.

(57) ABSTRACT

A cut-resistant yarn formed of a multifilament yarn, each filament of a polyester material having ceramic platelets embedded to provide a yarn having cut resistance, and the yarn having a friction-textured false twist inserted therein to provide a surface exhibiting comfort characteristics rendering the yarn suitable for use in apparel. An embodiment of the method of forming a cut-resistant yarn according to the invention includes the steps of providing a multifilament yarn. The filament is a polyester material having ceramic platelets embedded to provide a yarn having cut-resistance. False twist by the friction-texturing method is inserted to provide a surface exhibiting comfort characteristics rendering the yarn suitable for use in apparel.

10 Claims, 3 Drawing Sheets

FRICTION-TEXTURED CUT-RESISTANT YARN

This application is a continuation of prior application Ser. No. 09/929,148, filed Aug. 14, 2001, now U.S. Pat. No. 6,591,599, which claims the benefit of provisional application Ser. No. 60/225,669, filed Aug. 16, 2000. This invention relates to protective yarns, fabrics and apparel which have the properties of cut resistance, are form-fitting, do not overly diminish tactile sensitivity and dexterity, and have a soft surface for touching materials which may be easily scratched.

TECHNICAL FIELD AND BACKGROUND OF THE INVENTION

This invention relates to protective yarns, fabrics and apparel which have the properties of cut resistance, are form-fitting, do not overly diminish tactile sensitivity and dexterity, and have a soft surface for touching materials which may be easily scratched.

This invention is an abrasive, particle filled fiber (as described in Sandor, et al., U.S. Pat. No. 5,851,668, which is incorporated herein by reference) which has been friction-textured to make a soft yarn with stretch. In general, friction-twisting relates to a process by which thermoplastic textile yarns are twisted by passing the moving yarn around the edge of a rapidly rotating disc. The friction between the yarn and the rotating disc causes the yarn to be twisted about its longitudinal axis. The yarn is then knitted or woven into cut-resistant fabrics to make protective apparel such as gloves, sleeves, and other protective garments.

The benefits of this invention are softer, more comfortable garments, and improved dexterity when knitted or woven into protective apparel such as gloves, with the added stretch achieved from texturing making the glove conform to the hand without slipping.

Friction-texturing the particle-filled fiber produces a yarn, which when knitted or woven into fabric, is soft but not as slippery as other commonly used materials. The textured finish also enhances adhesion for dipped or screened coatings when applications require.

SUMMARY OF THE INVENTION

Therefore, it is an object of the invention to provide a friction-textured cut-resistant yarn.

It is another object of the invention to provide a friction-textured cut-resistant yarn which can be knitted or woven into a fabric exhibiting desirable wear and comfort characteristics.

It is another object of the invention to provide a friction-textured cut-resistant yarn which can be knitted or woven into a fabric exhibiting both desirable wear and comfort characteristics and undiminished cut-resistance.

These and other objects of the present invention are achieved in the preferred embodiments disclosed below by providing a cut-resistant yarn, comprising a multifilament yarn, each filament comprised of a polyester material having ceramic platelets embedded to provide a yarn having cut resistance, and the yarn having a friction-textured false twist inserted therein to provide a surface exhibiting comfort characteristics rendering the yarn suitable for use in apparel.

According to one preferred embodiment of the invention, the yarn before being friction-textured has a denier of between 20–500 denier.

According to another preferred embodiment of the invention, the yarn before being friction-textured has a denier of between 20–500 denier and after being friction-textured a denier of 180.

According to yet another preferred embodiment of the invention, the yarn before being friction-textured has a denier of between 20–500 denier, after being friction-textured a denier of 180, and is comprised of 68 filaments.

According to yet another preferred embodiment of the invention, the yarn before being friction-textured has a denier of 275 denier, after being friction-textured a denier of 180, and is comprised of 68 filaments.

According to yet another preferred embodiment of the invention, the yarn before being friction-textured is a partially-oriented yarn (POY) having a denier of 275 denier, after being friction-textured a denier of 180, and is comprised of 68 filaments.

According to yet another preferred embodiment of the invention, the yarn includes a strand of spandex yarn attached to the multifilament yarn for providing stretch to the yarn.

According to yet another preferred embodiment of the invention, the strand of spandex yarn is attached to the multifilament yarn by air tacking.

An embodiment of the method of forming a cut-resistant yarn according to the invention comprises the steps of providing a multifilament yarn, each filament comprised of a polyester material having ceramic platelets embedded to provide a yarn having cut resistance, and inserting friction-textured false twist therein to provide a surface exhibiting comfort characteristics rendering the yarn suitable for use in apparel.

According to yet another preferred embodiment of the invention, the step of providing a multifilament yarn comprises the step of providing a yarn wherein, before being friction-textured, the yarn has a denier of between 20–500 denier.

According to yet another preferred embodiment of the invention, the step of providing a multifilament yarn comprises the step of providing a yarn wherein, before being friction-textured, the yarn has a denier of between 20–500 denier, and the step of friction-texturing the yarn includes the step of twisting the yarn to provide a yarn after twisting with a denier of 180.

According to yet another preferred embodiment of the invention, the step of providing a multifilament yarn comprises the step of providing a yarn comprised of 68 filaments wherein, before being friction-textured, the yarn has a denier of between 20–500 denier, and wherein the step of friction-texturing the yarn includes the step of twisting the yarn to provide a yarn after twisting with a denier of 180.

According to yet another preferred embodiment of the invention, the step of providing a multifilament yarn comprises the step of providing a yarn comprised of 68 filaments wherein, before being friction-textured, the yarn has a denier of between 275 denier, and the step of friction-texturing the yarn includes the step of twisting the yarn to provide a yarn after twisting with a denier of 180.

According to yet another preferred embodiment of the invention, the yarn before being friction-textured is a partially-oriented yarn (POY) having a denier of 275 denier, after being friction-textured a denier of 180, and is comprised of 68 filaments.

According to yet another preferred embodiment of the invention, the invention includes step of attaching a strand of spandex yarn to the multifilament yarn during the friction-texturing false twist step for providing stretch to the yarn.

According to yet another preferred embodiment of the invention, the strand of spandex yarn is attached to the multifilament yarn by air tacking.

According to yet another preferred embodiment of the invention, the method includes the step of attaching a strand of spandex yarn to the multifilament yarn for providing stretch to the yarn in a step subsequent to the friction-texturing false twist step.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
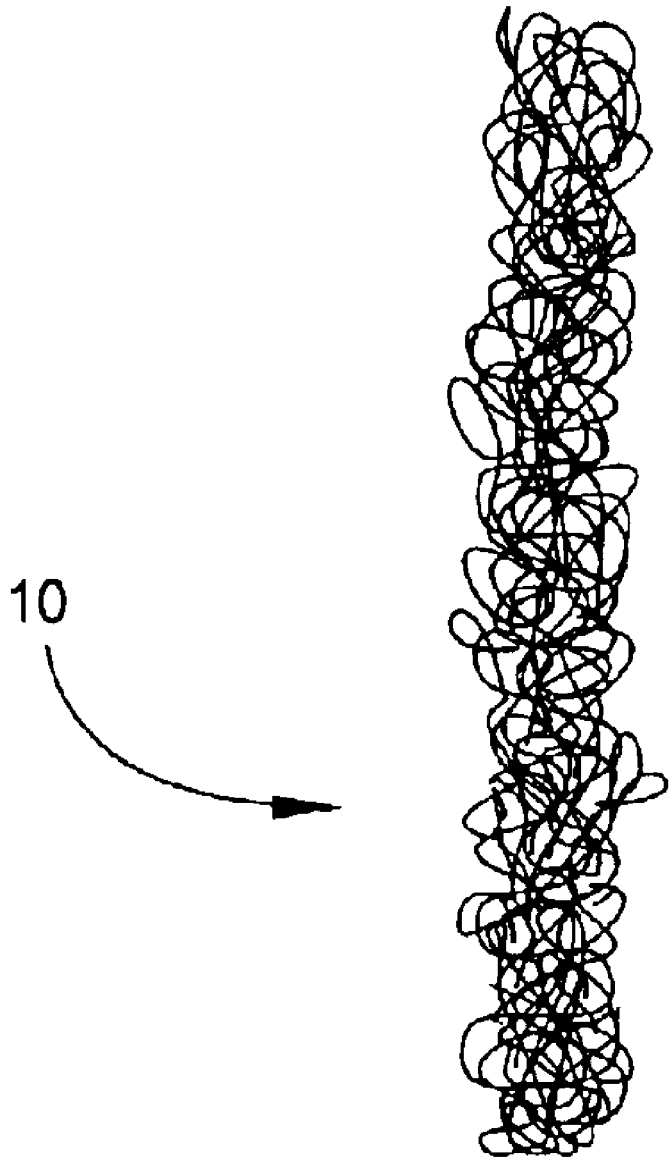
FIG. 1 is a view of a length of the false-twisted, cut-resistant yarn according to an embodiment of the invention.

Referring now specifically to the drawings, a cut-resistant yarn according to the present invention, not under tension, is illustrated in FIG. 1 and shown generally at reference numeral 10. The yarn 10 comprises a multifilament yarn, each filament comprised of a polyester material having ceramic platelets embedded to provide a yarn having cut resistance. The yarn is friction-textured on a false twist machine to provide a surface exhibiting comfort characteristics rendering the yarn suitable for use in apparel. As noted above, the yarn 10 is formed from a particle-filled fiber (as described in Sandor, et al., U.S. Pat. No. 5,851,668, which is incorporated herein by reference) which has been friction-textured to make a soft yarn with stretch. The friction-twisting process is one by which thermoplastic textile yarns are twisted by passing the moving yarn around the edge of a rapidly rotating disc. The friction between the yarn and the rotating disc causes the yarn to be twisted about its longitudinal axis. The yarn is then knitted or woven into cut-resistant fabrics to make protective apparel such as gloves, sleeves, and other protective garments.

An example of a cut-resistant yarn according to an embodiment of the invention is set out below:

| | |
|---|---|
| Feeder yarn | CRF 275-C15-68-2200 POY Polyester Yarn |
| Feeder yarn denier | 275 |
| Feeder yarn filaments | 68 |
| Texturing Machine | ICBT JD 800-3 Friction Twist Machine |
| Finish denier | 180 |
| Processing Temperature | 300 deg. C. |
| Friction Stack | 1-7-1 poly u |
| Draw ratio | 1.8 |
| DY | 1.55 |

Figure 2:
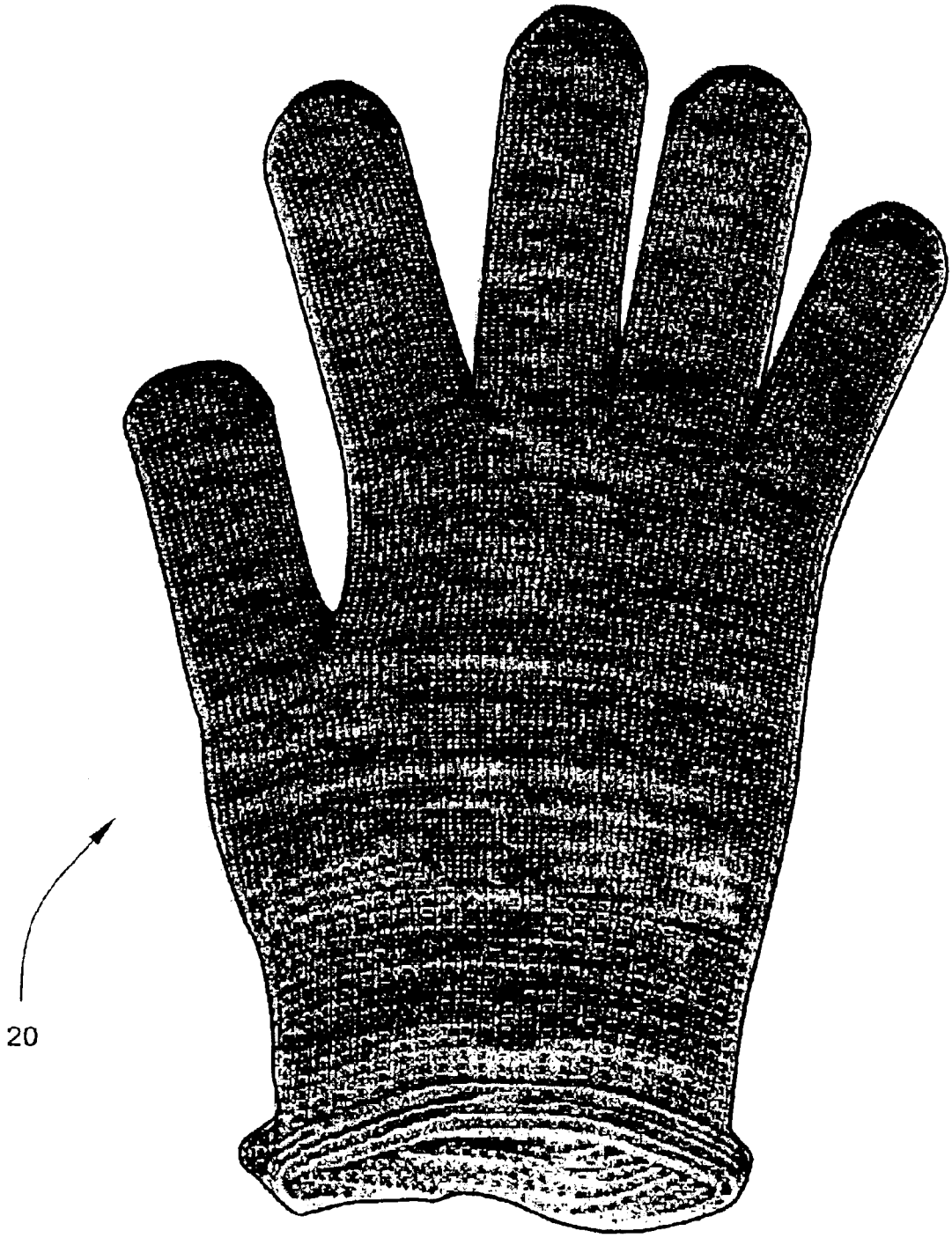
FIG. 2 is a perspective view of a glove manufactured from the yarn.

The yarn is particularly suitable for knitting protective garments such as a cut-resistant glove 20 such as shown in FIG. 2.

In accordance with another embodiment of the invention, the yarn 10 may be air tacked with an elastomeric yarn 25 such as Spandex elastomeric yarn, rubber or neoprene. Air tacking is a process by which the filaments of the textured yarn 10 are separated by a jet of air, providing space in the fiber bundle for the elastomeric yarn 25 to be entangled and thus held in place by those filaments.

Figure 3:
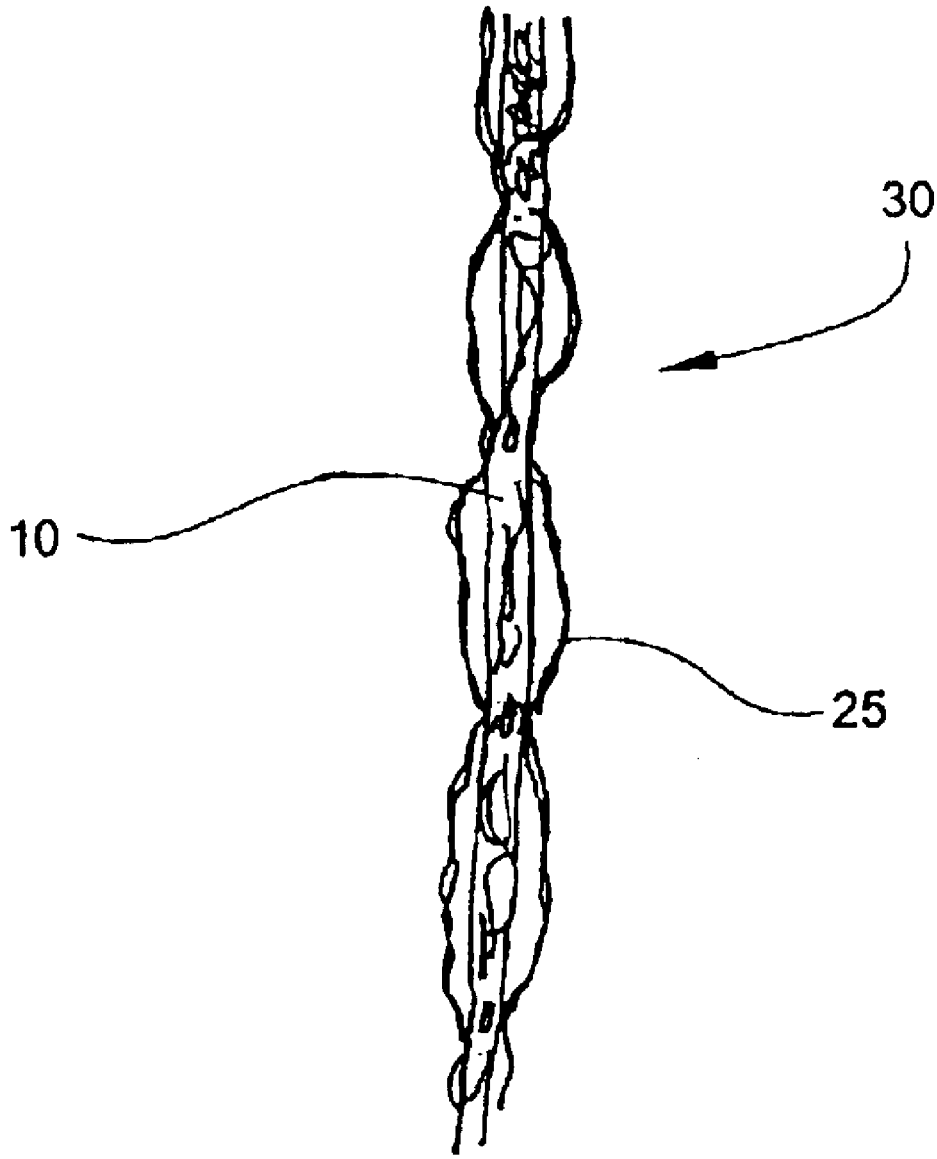
FIG. 3 is a view of a length of cut-resistant yarn with an elastomeric yarn tacked to it.

The tacking process may be carried out during the friction texturing process, or may be carried out as a separate step after the yarn has been removed from the friction-texturing machine. The resultant yarn 30, as shown in FIG. 3, is particularly useful where greater stretch recovery is desired in the yarn, or to make a more form-fitting knitted article, such as the glove 20 in FIG. 2.

The elastomeric yarn 25 is preferably in the range of 10–240 denier, and the cut-resistant yarn is in the range of 20–1000 denier.

In one preferred embodiment, 20 denier Spandex is tacked to a 150 denier friction-textured yarn, as follows:

| | |
|---|---|
| % spandex | 3.63 |
| % friction-textured, cut-resistant yarn | 96.37 |
| % elongation | 158.00 |

In another preferred embodiment, 40 denier Spandex is tacked to a two-ply 150 denier friction-textured yarn, as follows:

| | |
|---|---|
| % spandex | 4.00 |
| % friction-textured, cut-resistant yarn | 96.00 |
| % elongation | 150.00 |

A cut-resistant yarn formed of a multifilament yarn is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A cut-resistant yarn, comprising:

(a) a multifilament yarn, each filament comprised of a polyester material having ceramic platelets embedded to provide a yarn having cut resistance; and (b) said yarn having a friction-textured false twist inserted therein to provide a surface exhibiting comfort characteristics rendering the yarn suitable for use in apparel.

2. A cut-resistant yarn according to claim 1, wherein said yarn before being friction-textured has a denier of between 20–500 denier.

3. A cut-resistant yarn according to claim 1, wherein said yarn before being friction-textured has a denier of between 20–500 denier and after being friction-textured a denier of 180.

4. A cut-resistant yarn according to claim 1, wherein said yarn before being friction-textured has a denier of between 20–500 denier, after being friction-textured a denier of 180, and is comprised of 68 filaments.

5. A cut-resistant yarn according to claim 1, wherein said yarn before being friction-textured has a denier of 275 denier, after being friction-textured a denier of 180, and is comprised of 68 filaments.

6. A cut-resistant yarn according to claim 1, wherein said yarn before being friction-textured is a partially-oriented yarn (POY) having a denier of 275 denier, after being friction-textured a denier of 180, and is comprised of 68 filaments.

7. A cut-resistant yarn, comprising:

(a) a multifilament yarn comprising a particle filled fiber for providing cut resistance; and (b) said yarn having a friction-textured false twist inserted therein to provide a surface exhibiting comfort characteristics rendering the yarn suitable for use in apparel.

8. A cut-resistant yarn according to claim 7, wherein said particle filled fiber comprises a polymer embedded with hard particles having a Mohs Hardness Value greater than 3.

9. A cut-resistant yarn, comprising:

(a) a multifilament yarn, each filament comprised of a polyester material having hard particles embedded therein to provide a yarn having cut resistance; and (b) said yarn having a friction-textured false twist inserted therein to provide a surface exhibiting comfort characteristics rendering the yarn suitable for use in apparel.

10. A cut-resistant yarn according to claim 9, wherein said hard particles have a Mohs Hardness Value greater than 3.

* * * * *